US008464700B2

(12) United States Patent
Smith et al.

(10) Patent No.: US 8,464,700 B2
(45) Date of Patent: Jun. 18, 2013

(54) BOWFISHING METHOD AND APPARATUS

(75) Inventors: Matthew R. Smith, Elizabethtown, PA (US); Dave B. Parker, Lebanon, PA (US)

(73) Assignee: Kinsey Archery Products, Inc., Mount Joy, PA (US)

( * ) Notice: Subject to any disclaimer, the term of this patent is extended or adjusted under 35 U.S.C. 154(b) by 315 days.

(21) Appl. No.: 12/858,580

(22) Filed: Aug. 18, 2010

(65) Prior Publication Data

US 2012/0042863 A1 Feb. 23, 2012

(51) Int. Cl.
*F41G 1/467* (2006.01)

(52) U.S. Cl.
USPC ..... 124/87; 33/265

(58) Field of Classification Search
USPC ..... 124/23.1, 86, 87, 88; 33/265
See application file for complete search history.

(56) References Cited

U.S. PATENT DOCUMENTS

| | | | |
|---|---|---|---|
| 4,704,800 | A | 11/1987 | Stinson |
| 5,419,050 | A | 5/1995 | Moore |
| 5,448,936 | A | 9/1995 | Turner |
| 5,491,546 | A | 2/1996 | Wascher et al. |
| 5,495,675 | A | 3/1996 | Huang |
| 5,782,002 | A | 7/1998 | Reed |
| 6,073,352 | A | 6/2000 | Zykan et al. |
| 6,094,829 | A | 8/2000 | Koestler, III |
| 6,134,793 | A | 10/2000 | Sauers |
| 6,199,286 | B1 | 3/2001 | Reed, Jr. et al. |
| 6,366,344 | B1 | 4/2002 | Lach |
| 6,526,666 | B1 | 3/2003 | Lastinger, Jr. |
| 6,644,297 | B1 | 11/2003 | Brown, Jr. |
| 6,851,197 | B2 | 2/2005 | Terry et al. |
| 6,862,813 | B1 | 3/2005 | Chen et al. |
| 7,231,721 | B2 | 6/2007 | Minica et al. |
| 7,313,871 | B2 | 1/2008 | Lines et al. |
| 7,409,770 | B2 | 8/2008 | Jones |
| 7,584,543 | B1 | 9/2009 | Boyd |
| 2006/0112574 | A1 | 6/2006 | Hodge et al. |
| 2006/0156560 | A1 | 7/2006 | Lines et al. |
| 2008/0010842 | A1 | 1/2008 | Jones |
| 2008/0134526 | A1 | 6/2008 | Christensen |
| 2008/0216331 | A1 | 9/2008 | Jones |
| 2009/0051989 | A1 | 2/2009 | Dobschal et al. |
| 2009/0144994 | A1 | 6/2009 | Taboada et al. |
| 2009/0293855 | A1 | 12/2009 | Danielson et al. |

FOREIGN PATENT DOCUMENTS

| | | | |
|---|---|---|---|
| GB | 2446206 | A | 8/2008 |
| JP | 20044163074 | A | 6/2004 |
| WO | 2004094934 | A3 | 11/2004 |
| WO | 2008093135 | A1 | 8/2008 |

*Primary Examiner* — John Ricci
(74) *Attorney, Agent, or Firm* — McNees Wallace & Nurick LLC

(57) ABSTRACT

The present invention relates to a bowfishing method, bowfishing system and laser bowfishing sight for targeting and illuminating an underwater target. The position of the target is compensated for the refraction of light in the practice of the method and sighting in of the system of the present invention. The laser bowfishing sight includes a rotational adjustment for compensating for the refraction of light.

20 Claims, 3 Drawing Sheets

BOWFISHING METHOD AND APPARATUS

FIELD OF THE INVENTION

The present invention generally relates to bowfishing, and more particularly to a method and apparatus for bowfishing using a laser sight.

BACKGROUND

The sport of bowfishing has been very popular for many years and most recently the interest in this exciting sport has skyrocketed. In bowfishing, an archer is able to practice hunting skills at any time of the year, and at the same time is able to enjoy the sport of fishing.

As is known to those skilled in the art, fishing with an archery bow involves the use of a bow, arrow and retrieval system. The archer, upon visually locating an underwater or sub-surface target, launches an arrow at the sub-surface target. The arrow is tethered by a line leading from the arrow to a reel or other line dispensing device. Upon launching the arrow, the line permits the arrow to be retrieved, hopefully with a speared fish thereupon.

The bowfisherman visually targets or designates the fish. Most often, the bowfisherman targets the fish unassisted, or in other words by sighting the fish by the shaft of the arrow or by an instinctive shooting technique. The bowfisherman may also use an assist or sight, such as a pin sight. In either technique, the bowfisherman needs to compensate for the diffraction of light entering the water, and estimate the correct aim point of the arrow. Frequently, the bowfisherman may over or under estimate the position of the sub-surface target and miss the target.

Accordingly, there is a need in the industry for a bowfishing target designation method and apparatus that improves accuracy at an affordable price.

SUMMARY OF THE INVENTION

An objective of the present invention is to provide method and apparatus for bowfishing including using a laser sight to designate a sub-surface target.

According to one aspect of the present invention, a method of targeting an arrow on an underwater target with a laser sight is disclosed. The method includes illuminating a target located below a water surface with a laser, and launching an arrow from a bow at the target.

According to another aspect of the present invention, a bowfishing system is disclosed that includes a bow, and a laser sight attached to the bow. The laser sight includes a laser, a switch for activating the laser, and an attachment device for releasably attaching the laser bowfishing sight to the bow. The attachment device includes a base portion and an adjustment portion attached at an attachment point. The attachment device is configured to adjust the linear distance of the laser from the attachment points. The attachment device is configured to rotate the projected laser beam about the attachment point through a vertical plane.

According to yet another aspect of the present invention, a laser sight is disclosed that includes a laser, a switch for activating the laser to project a laser beam, and an attachment device for releasably attaching the laser to a bow. The attachment device includes a base portion and an adjustment portion attached at an attachment point to the base portion for releasably attaching the laser bowfishing sight to a bow. The attachment device is configured to adjust the linear distance of the laser from the attachment points. The attachment device is configured to rotate the projected laser beam about the attachment point through a vertical plane.

BRIEF DESCRIPTION OF THE DRAWINGS

Referring now to the figures, which are exemplary embodiments, and wherein the like elements are numbered alike.

DETAILED DESCRIPTION

Specific embodiments of systems and processes for bowfishing use a laser sight according to the invention are described below with reference to the drawings.

Figure 1:
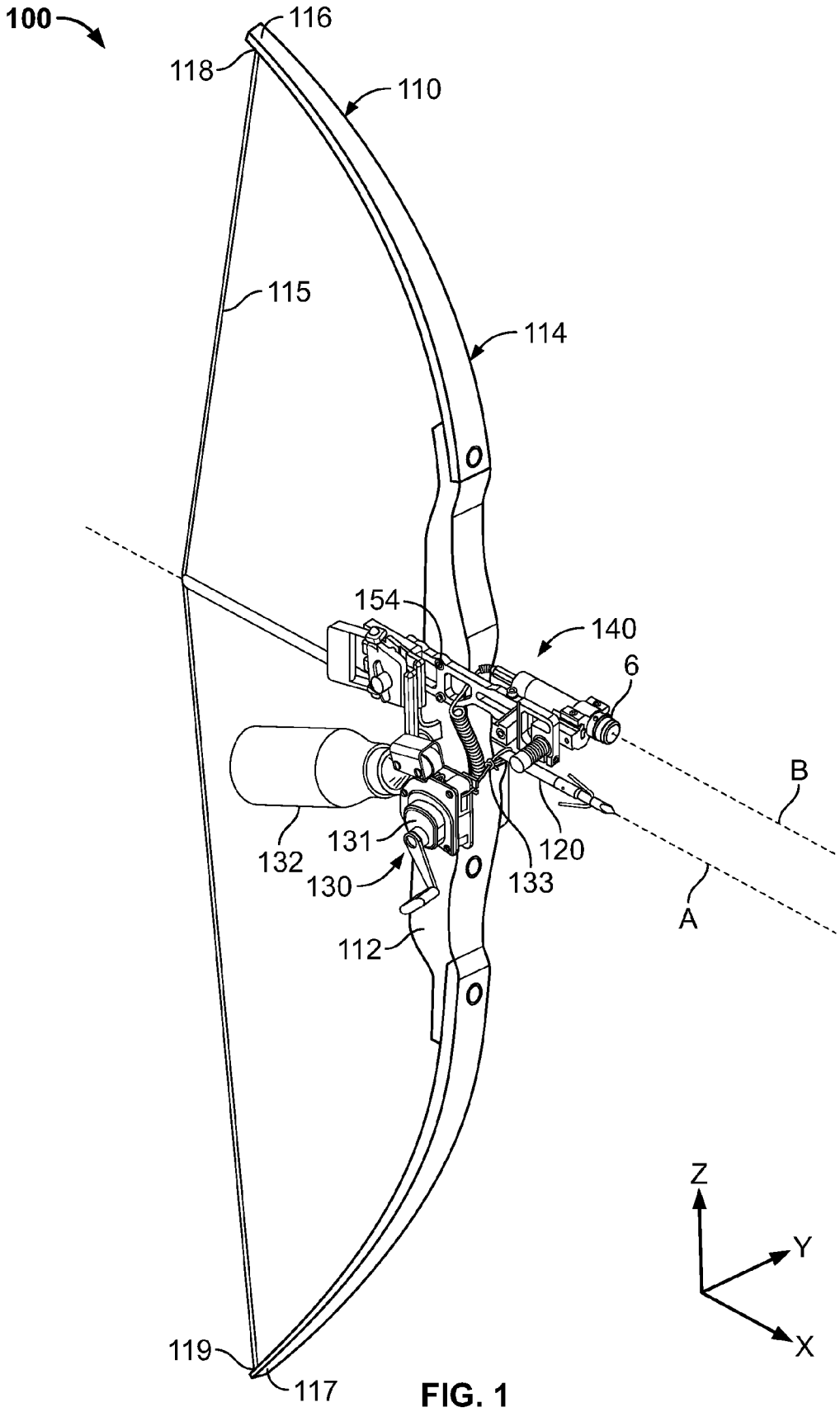
FIG. 1 is a perspective view of an exemplary bowfishing system according to an embodiment of the disclosure.

FIG. 1 illustrates an exemplary bowfishing system 100 according to an embodiment of the invention. As can be seen in FIG. 1, the bowfishing system 100 includes a bow 110, an arrow 120, an arrow retrieval system 130, and a laser sight 140 removably fastened to the bow 110. The bow 110 includes a body or riser 112, a pair of limbs 114 attached to the riser 112, and a bowstring 115. In another embodiment, the riser 112 and limbs 114 may be a unitary construction. In another embodiment, the bow 110 may be formed of one or more components. The yet another embodiment, the bow may be a compound bow, recurve bow, longbow or crossbow. The bow 110 includes a top end 116 and a bottom end 117 proximate to a first end 118 and a second end 118, respectively, of bowstring 115. The arrow 120 has a length axis A.

The arrow retrieval system 130 includes a spool 131, housing 132 and a line 133. The line 133 is stored in the housing 132, attached to the arrow 120 and is retrievable by the spool 131. In another embodiment, the arrow retrieval system 130 may include a line 133 attached to the arrow 120, and the line may or may not be terminated to the bow 110.

Figure 2:
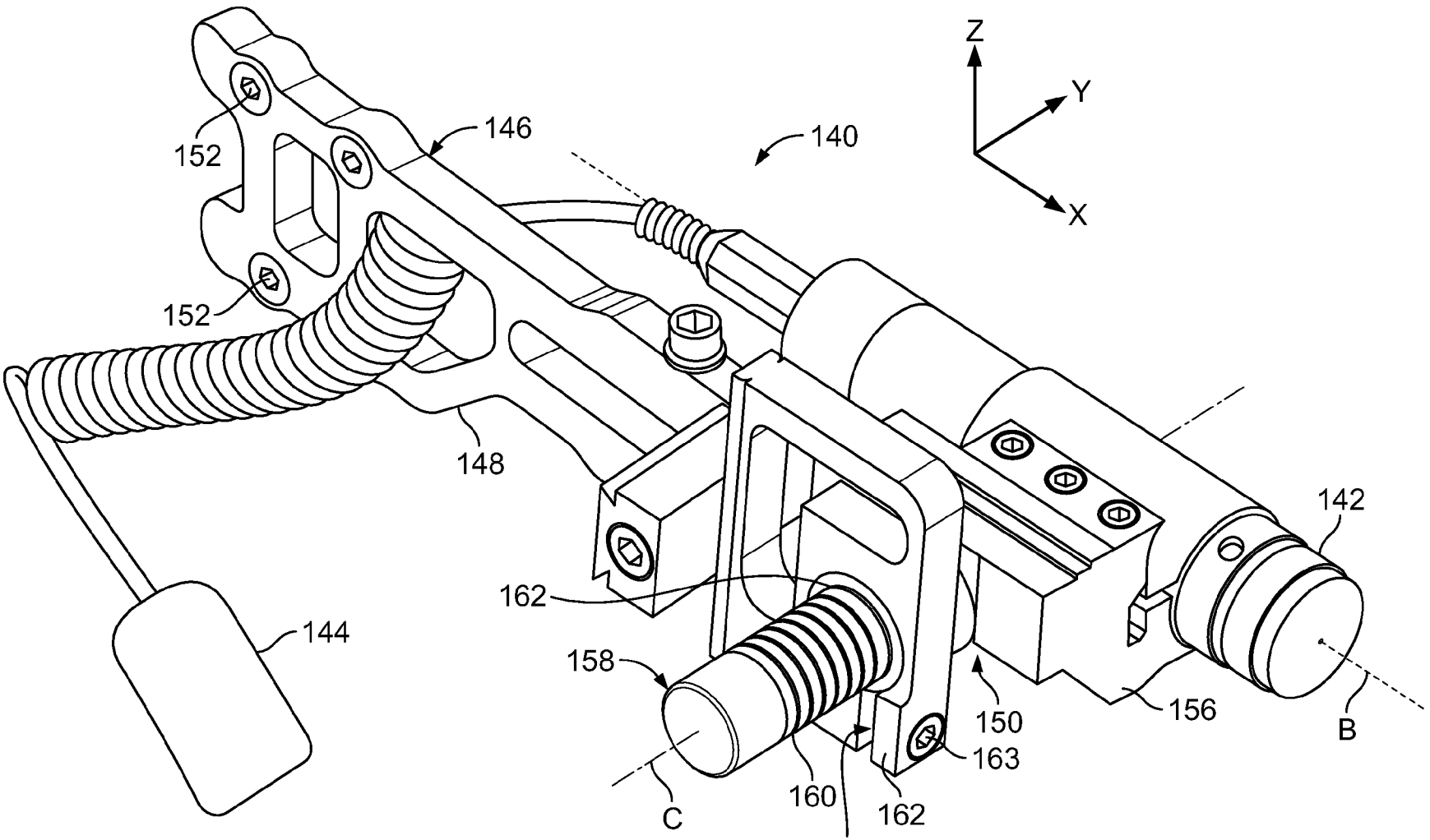
FIG. 2 illustrates an exemplary application of the bowfishing system according to an embodiment of the disclosure.

FIG. 2 shows an embodiment of the laser sight 140. The laser sight 140 includes a laser 142, a switch 144 and an attachment device 146. The laser 142 is a 5 millliwatt (mW) green laser having a power output of about 5 milliwatt (mW). In another embodiment, the laser 142 may be a red, blue or green laser, and may have a power output of between about 1 to about 30 millliwatt (mW). The laser 142 includes an internal power supply (not shown). In another embodiment, the power supply may be external to the laser 142. The laser 142 produces a directed beam of visual light that illuminates or projects a point of light upon a surface, such as a target. The laser 142 projects the beam of light along axis B.

The switch 144 controls power supplied to the laser 142. The switch 144 may be attached to the bow 110. The switch 144 may be attached to the bow by, but not limited to, an adhesive, an adhesive pressure tape or a fastener. The switch 144 may be a pressure switch. In yet another embodiment, the switch 144 may be incorporated into the laser 142.

The attachment device 146 provides support for the laser 142 and attachment of the laser 142 to the bow 110. The attachment device 146 includes a base portion 148 and an adjustment portion 150. The base portion 148 includes one or more attachment points 152 for receiving fasteners 154 (FIG. 1) for removably fastening the attachment device 146 to the bow 110. The base portion 148 further includes a opening 162 having a diameter. The opening 162 is open to a slot 162*a*. The diameter of the opening 162 may be adjusted by tightening or loosening a fastener 163 that narrows or widens the slot 162*a*.

The adjustment portion 150 includes an attachment portion 156 and an extension portion 158. The attachment portion 156 is configured to secure the laser 110 to the attachment device 146. In this exemplary embodiment, the attachment portion 158 releasably clamps around the laser 110 to attach the laser 142 to the attachment device 146. In another embodiment, the attachment portion 156 is integral to the laser 110. In another embodiment, the attachment portion 156 attaches the laser 110 to the adjustment portion with fasteners, straps, ties, wire, hook and loop straps or tape, or other fastening device.

The extension portion 158 adjustably attaches the laser 110 to the base portion 148. The extension portion 158 includes a shaft 160 that is received through opening 162 in the base portion 148. As discussed above, the base portion 148 includes a fastener 163 for tightening the opening 162 around the shaft 160 to releasably attach the laser 110 in a secure position in the X, Y and Z axis. The opening 162 may be loosened from around the shaft 160 by adjusting the fastener 162 to reposition the laser 110 in one or more of the X, Y and Z axis. In another embodiment, the opening 162 is frictionally fitted to the shaft 160 so that the shaft 160 may be rotated in the Z-X plane around an attachment point axis "C" and/or extended and/or retracted in the Y direction. The shaft 160 is rotationally coupled in the X-Z plane so as to pivot or rotate about the attachment point axis "C", which is the same as the axis of the shaft 160, and axially coupled in the Y direction. By extending and/or retracting the shaft 160, the linear distance separating the laser 110 from the attachment points 152, and the bow 120 when attached, may be adjusted. In another embodiment, the extension portion 158 is integral to the attachment portion 156.

Figure 3:
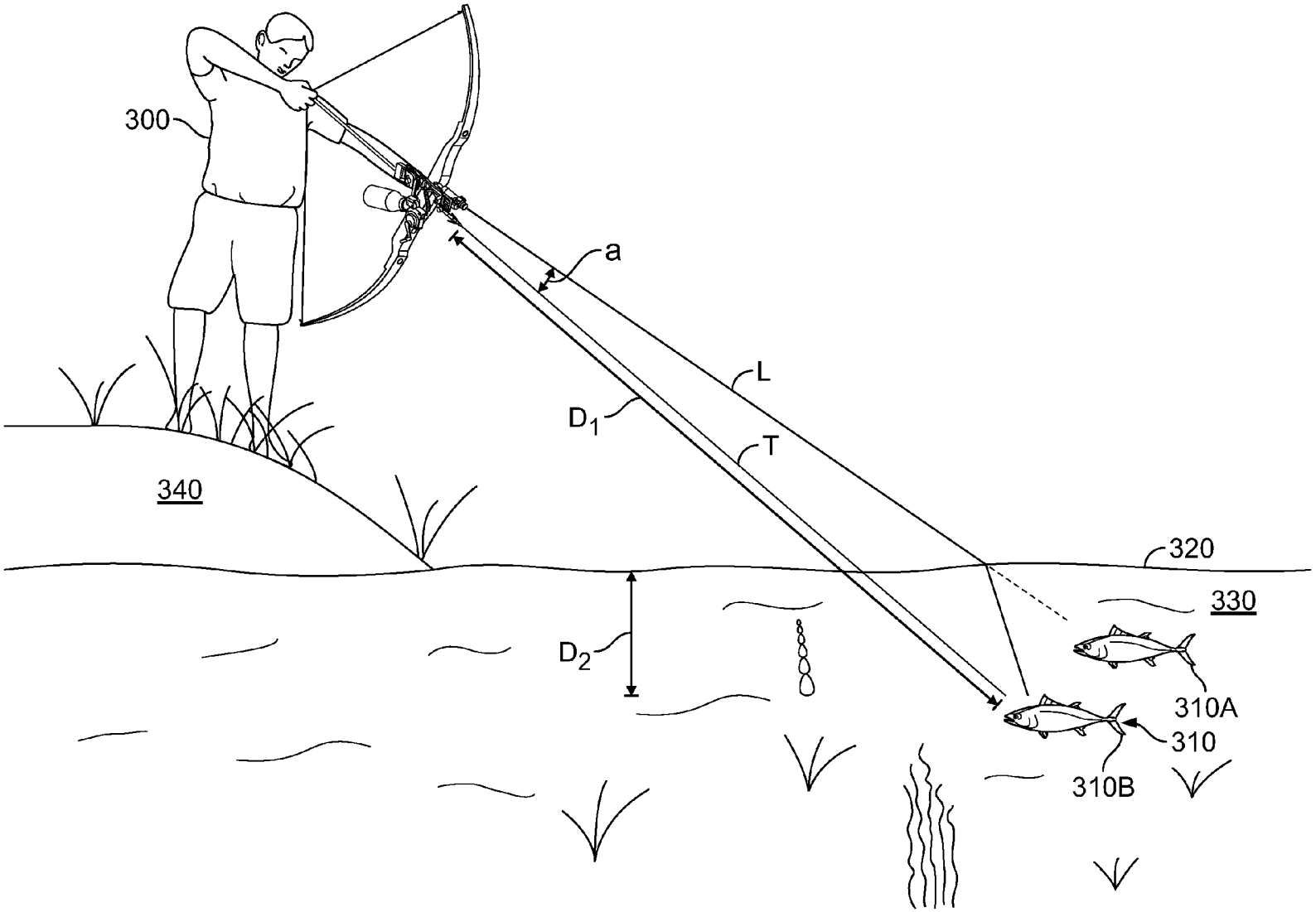
FIG. 3 illustrates an exemplary trajectory of the bowfishing system according to an embodiment of the disclosure.

FIG. 3 illustrates an exemplary bowfishing scenario according to an embodiment of the invention. As can be seen in FIG. 3, a bowfisherman 300 acquires, locates or otherwise identifies a target 310 located below the water surface 320 of body of water 330. In this exemplary scenario, the target 310 is a fish. In another embodiment, the target 310 may be any sub-surface target, including, but not limited to both natural and man-made inanimate objects such as structures and trees, fish and animals. Additionally, the bowfisherman 300 is located on land 340, however, in other embodiments, the bowfisherman 300 may be located on a dock, pier, boat, tree-stand or other similar fixed or mobile location.

The apparent position 310A and actual position 310B of the fish 310 differ or are offset because the direction of light propagation has been changed as the light passes from the more dense water into the less dense air. As can be seen in FIG. 3, the path of light "L" is not linear to the bowfisherman 300. Thus, the trajectory "T" of the arrow 120 must be adjusted by an offset angle "a" to compensate for the refraction of light. As can be further seen in FIG. 3, the actual position 310A is deeper and horizontally closer to the bowfisherman 300 than the apparent position 310A.

Referring to FIGS. 1 and 3, the laser sight 140 is adjusted so that the projection of the laser beam along axis B is coplanar with a vertical X-Z plane passing through the bowstring 115 and arrow 120. By rotating the shaft 160 of the laser sight 140, the projected beam may be adjusted to intersect a trajectory "T" of the arrow 120 at the actual target 310B at a selected linear distance D1. In order to compensate for the refraction of light at the water surface 320, the projected beam is adjusted to intersect the trajectory of the arrow 120 at the position of the actual target 310B at the distance D1 and at a depth D2 below the water surface 320. This adjustment may be referred to as "sighting in" or "tuning". In such a manner, a bowfisherman 300 may improve the accuracy of placing an arrow 120 on a target 310. Without this sighting in process, a bowfisherman 300 is likely to shoot over the target 310 by aiming the arrow at the apparent position 310A.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of targeting an arrow on an underwater target with a laser sight, comprising the steps of:

providing a bow;

providing the laser sight attached to the bow, wherein the laser sight further comprises:

a laser;

a switch for activating the laser; and an attachment device for releasably attaching the laser bowfishing sight to the bow;

wherein the attachment device comprises a base portion and an adjustment portion attached at an attachment point;

wherein the attachment device is configured to adjust the linear distance of the laser from the attachment point; and wherein the attachment device is configured to rotate the laser about the attachment point through a vertical plane;

activating the laser with the switch to project a laser beam;

illuminating a target located below a water surface with the laser beam, a path of the laser beam to the underwater target being non-linear due to refraction of the laser beam;

adjusting the trajectory of the arrow by an offset angle to compensate for the refraction of the laser beam, the offset angle being the angle of refraction of light passing from air into water; and launching the arrow from the bow in a straight line at the illuminated, underwater target.

2. The method of claim 1, further comprising:

determining the offset angle of the trajectory of the arrow from a point that the laser illuminates a known target position at a proximate target distance and depth below the water surface; and adjusting the trajectory of the arrow to compensate for the offset angle and proximate depth below the water surface.

3. The method of claim 1, wherein the laser is selected from a group consisting of a green laser, a red laser and a blue laser.

4. The method of claim 1, wherein the laser is a green laser.

5. The method of claim 1, wherein the laser has a power output of about 1 to about 30 mW.

6. The method of claim 1, wherein the laser is a green laser having a power output of about 5 mW.

7. The method of claim 1, wherein the laser is controlled by a pressure switch.

8. A bowfishing system, comprising:

a bow; and a laser sight attached to the bow;

wherein the laser sight comprises:

a laser;

a switch for activating the laser;

a retrieval system attached to the bow that includes a spool, a housing, a line; and an attachment device for releasably attaching the laser bowfishing sight to the bow; and wherein the attachment device comprises a base portion having an opening, an extension portion and an adjustment portion including an attachment portion, the extension portion further including a shaft received through the opening in the base portion, the shaft releasably attached to the attachment portion to reposition the laser in one or more of an X, Y and Z direction.

9. The system of claim 8, wherein the base portion further includes one or more attachment points for removably fastening the attachment device to a bow.

10. The system of claim 8, wherein the laser is selected from a group consisting of a green laser, a red laser and a blue laser.

11. The system of claim 8, wherein the laser is a green laser.

12. The system of claim 8, wherein the laser has a power output of about 1 mW to about 30 mW.

13. The system of claim 8, wherein the laser is a green laser having a power output of about 5 mW.

14. The system of claim 8, wherein the switch is a pressure switch.

15. A laser bowfishing sight, comprising:

a laser;

a switch for activating the laser to project a laser beam; and an attachment device for releasably attaching the laser to a bow, the attachment device comprising a base portion and an adjustment portion attached at an attachment point to the base portion for releasably attaching the laser bowfishing sight to a bow;

wherein the attachment device is configured to adjust the linear distance of the laser from the attachment point; and wherein the attachment device is configured to rotate the projected laser beam about the attachment point through a vertical plane.

16. The laser bowfishing sight of claim 15, wherein the base portion includes one or more attachment points for removably fastening the attachment device to a bow.

17. The laser bowfishing sight of claim 15, wherein the laser is selected from the group consisting of a red laser, a blue laser, and a green laser.

18. The laser bowfishing sight of claim 15, wherein the laser has a power output of between about 1 mW to about 30 mW.

19. The laser bowfishing sight of claim 15, wherein the laser is a green laser having a power output of about 5 mW.

20. The laser bowfishing sight of claim 15, wherein the switch is a pressure switch.

* * * * *